US005313905A

United States Patent [19]

Calderon

[11] Patent Number: 5,313,905

[45] Date of Patent: May 24, 1994

[54] TWIN WING SAILING YACHT

[76] Inventor: Albert A. Calderon, 410 Fern Glen, La Jolla, Calif. 92037

[21] Appl. No.: 880,645

[22] Filed: May 8, 1992

Related U.S. Application Data

[63] Continuation-in-part of Ser. No. 699,311, May 9, 1991, Pat. No. 5,163,377.

[51] Int. Cl.[5] ..... B63B 3/38

[52] U.S. Cl. ..... 114/140; 114/144 R; 114/144 E; 114/150; 114/163

[58] Field of Search ..... 114/39.1, 128, 140, 114/163, 167, 150, 144 R, 144 E, 162, 281

[56] References Cited

U.S. PATENT DOCUMENTS

| | | | |
|---|---|---|---|
| 979,383 | 12/1910 | Crawford | 114/163 |
| 1,780,767 | 11/1930 | Scott-Paine | 114/163 |
| 1,882,357 | 10/1932 | Cross | 114/162 |
| 3,080,845 | 3/1963 | Pollak | 114/163 X |
| 3,324,815 | 6/1967 | Morales | 114/39.1 X |
| 4,193,366 | 3/1980 | Salminen | 114/39.1 |
| 4,686,922 | 8/1987 | Burroughs | 114/140 X |

FOREIGN PATENT DOCUMENTS

| | | | |
|---|---|---|---|
| 0200080 | 9/1986 | Japan | 114/281 |
| 2226281 | 6/1990 | United Kingdom | 114/140 |

*Primary Examiner*—Sherman Basinger
*Attorney, Agent, or Firm*—Robert B. Block

[57] ABSTRACT

A twin wing sailing yacht having a pair of wing appendages depending from a canoe or hull, the wing appendages including structures which support at their lower ends a fore and aft extending ballast tandemly suspended between them. The wings are rotatable about generally vertical axes under the control of collective and cyclic steering mechanisms.

33 Claims, 12 Drawing Sheets

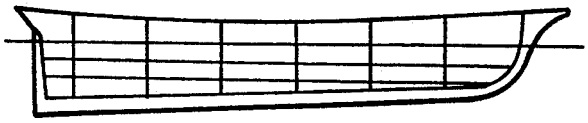
Fig. 1A
PRIOR ART
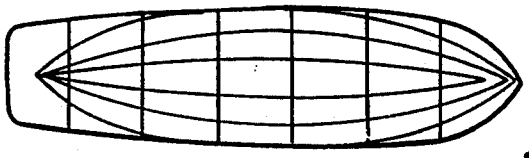
Fig. 1B
PRIOR ART
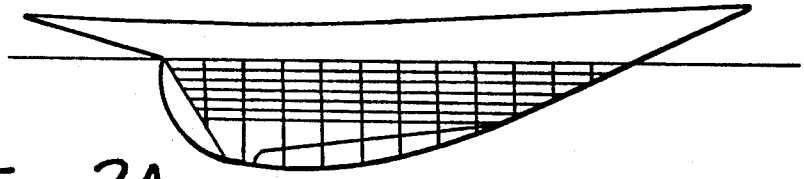
Fig. 2A
PRIOR ART
Fig. 2C PRIOR ART
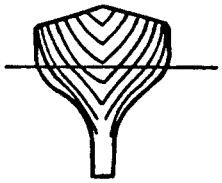
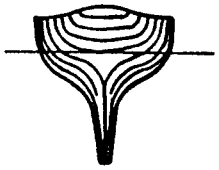
Fig. 2B
PRIOR ART
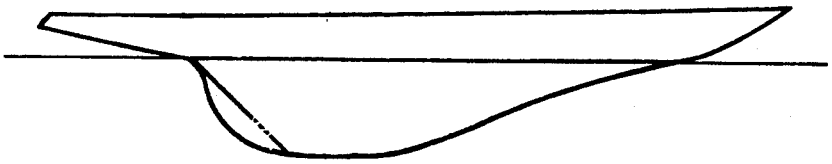
Fig. 3
PRIOR ART

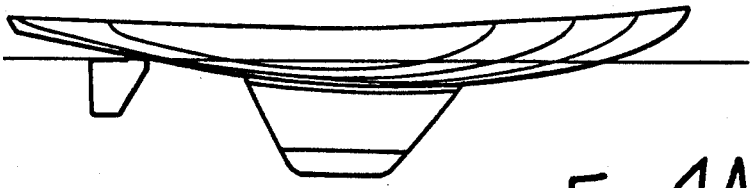
Fig. 4A
PRIOR ART
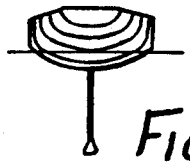
Fig. 4B
PRIOR ART
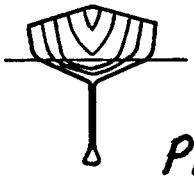
Fig. 4C
PRIOR ART
Fig. 5C PRIOR ART
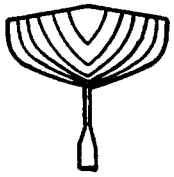
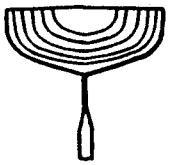
Fig. 5B
PRIOR ART
Fig. 5A PRIOR ART
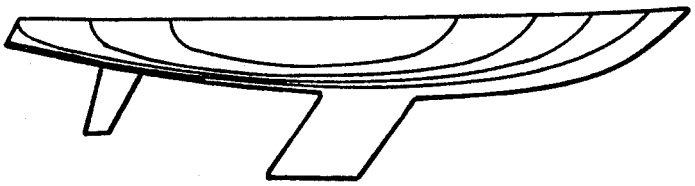
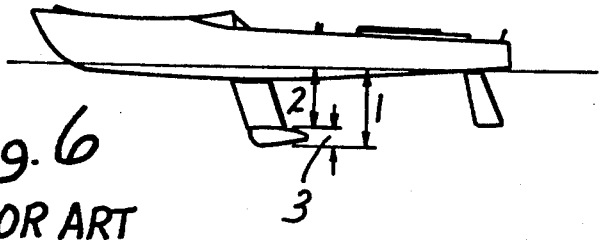
Fig. 6
PRIOR ART Fig. 13
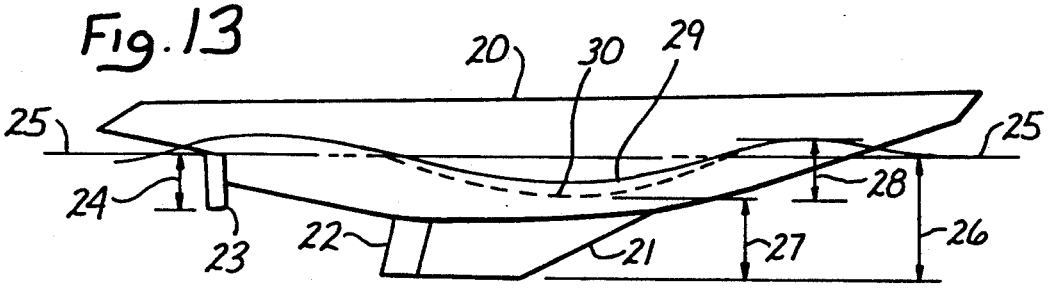
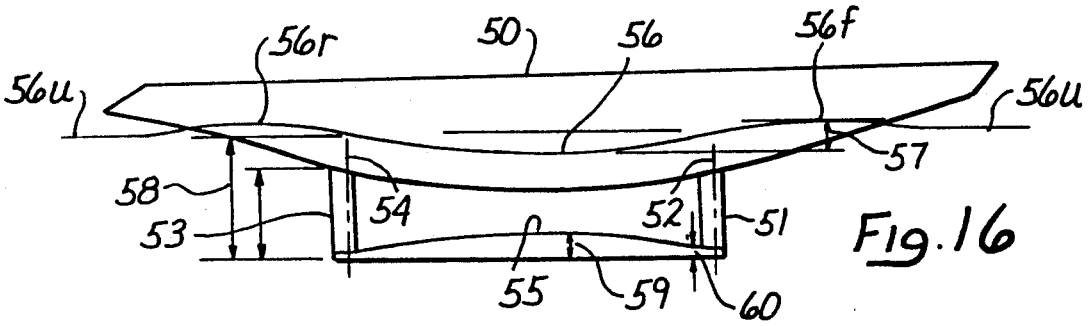
Fig. 16
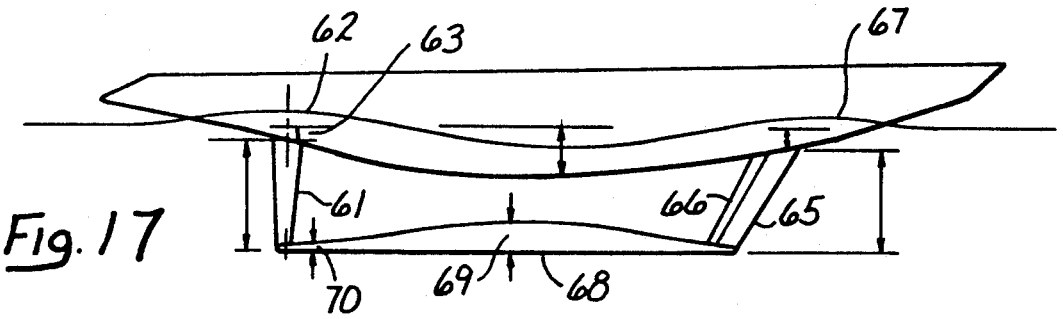
Fig. 17
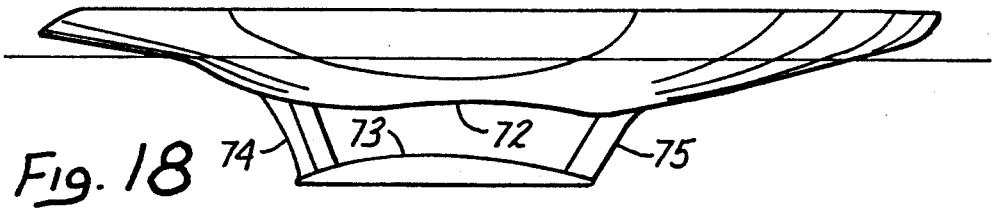
Fig. 18

Fig. 14A
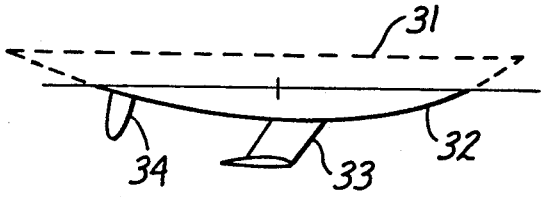
Fig. 15A
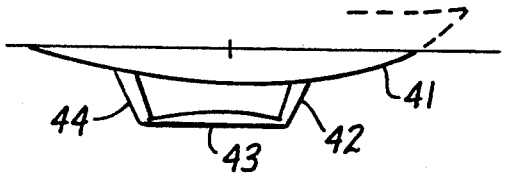
Fig. 14B
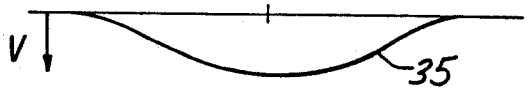
Fig. 15B
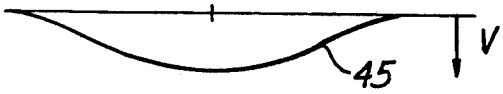
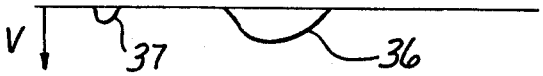
Fig. 14C
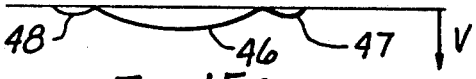
Fig. 15C
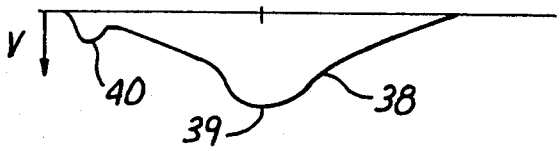
Fig. 14D
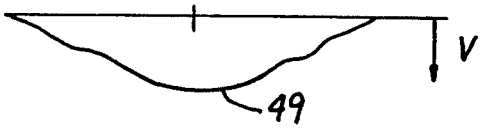
Fig. 15D Fig. 19
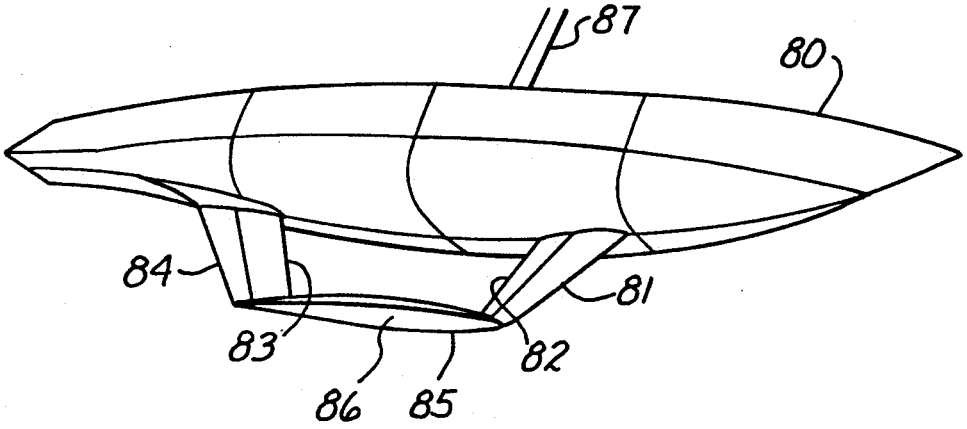
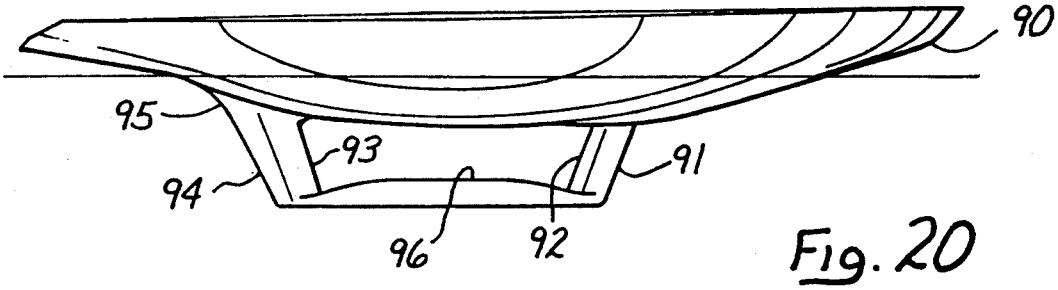
Fig. 20
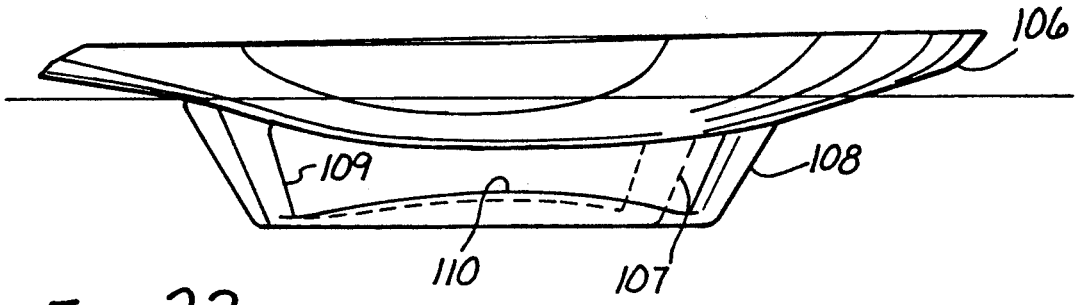
Fig. 22

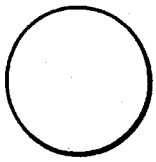
Fig. 23
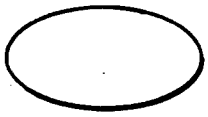
Fig. 24
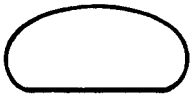
Fig. 25
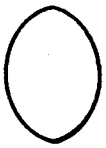
Fig. 26
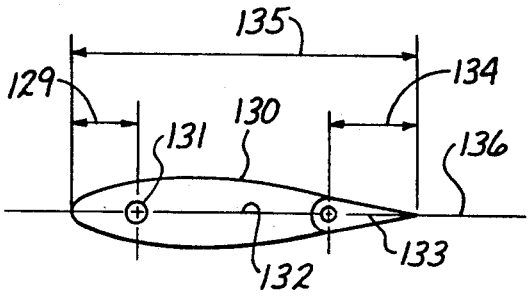
Fig. 27
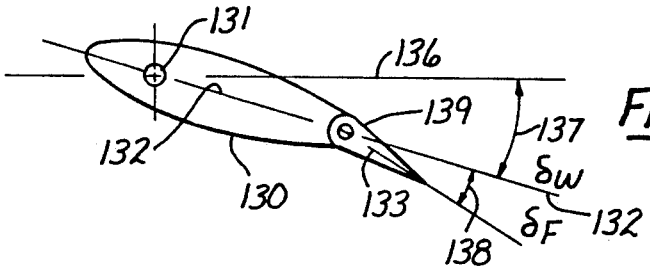
Fig. 28
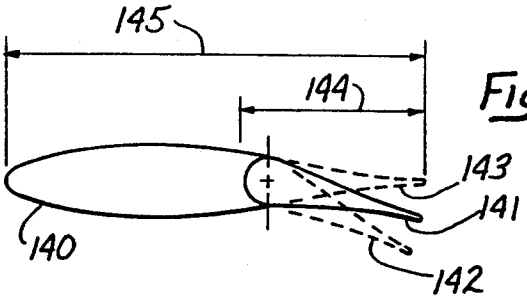
Fig. 30
Fig. 31
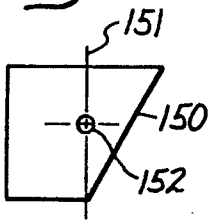
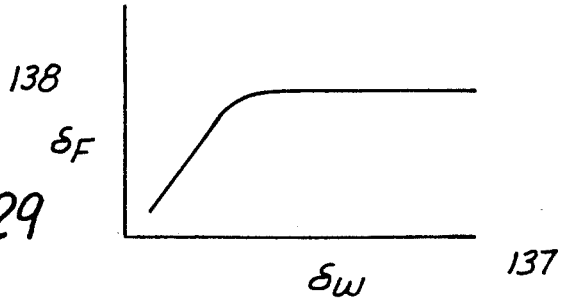
Fig. 29

Fig. 32
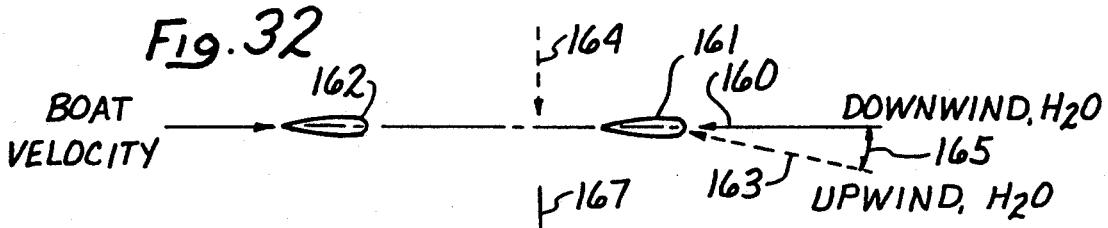
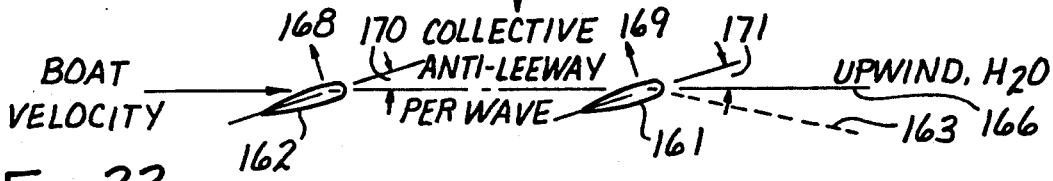
Fig. 33
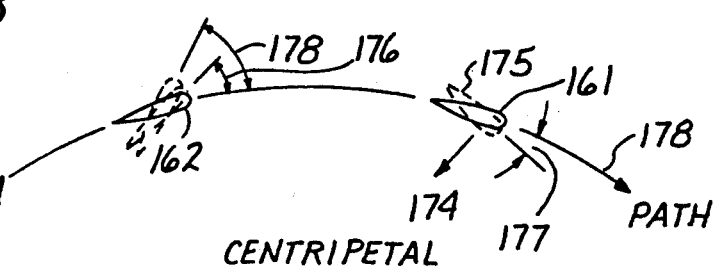
Fig. 34
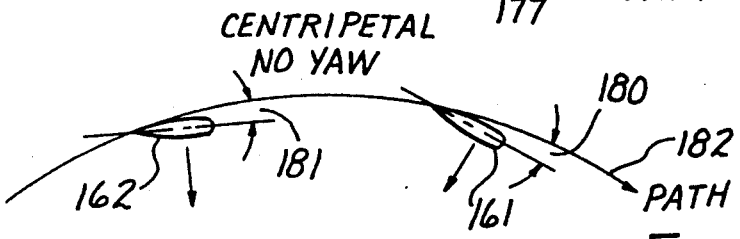
Fig. 35
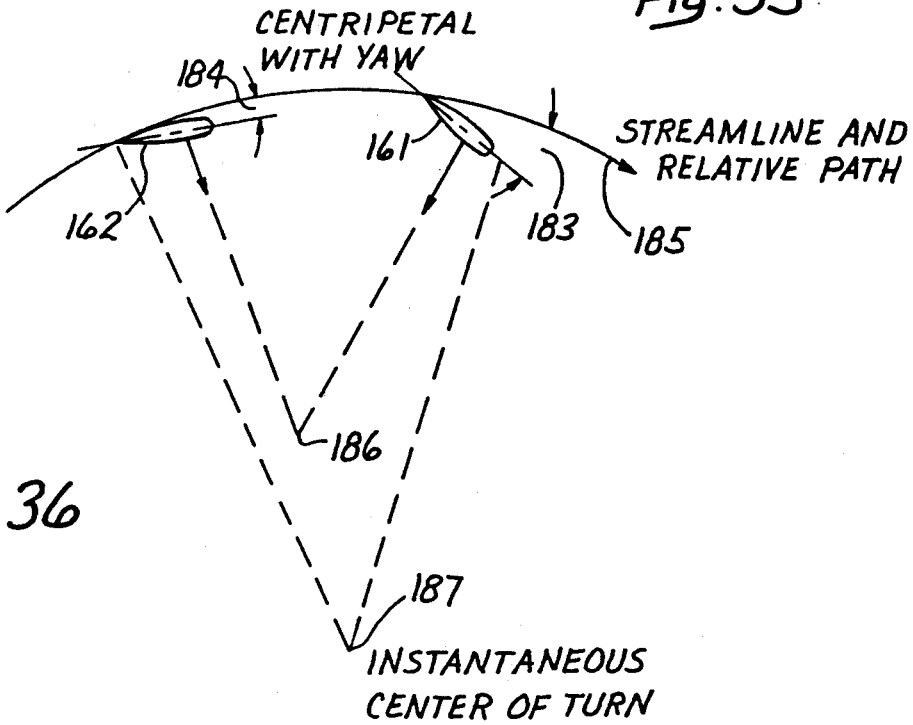
Fig. 36

TWIN WING SAILING YACHT

CROSS-REFERENCE TO RELATED APPLICATION

Reference is made to co-pending application entitled SAILING YACHT, Ser. No. 07/699,311, filed 9 May 1991, now U.S. Pat. No. 5,163,377, issued Nov. 17, 1992 in the names of Calderon et al., and assigned to the same assignee as the present application, which prior application is incorporated herein by reference in its entirety, and of which the present application is a continuation-in-part.

FIELD OF THE INVENTION

This invention relates to sailing yachts. More particularly, it pertains to innovative dynamic, hydrodynamic, hydro-aerodynamic, gravitational, structural, mechanical, and control features, improvements, and sailing techniques for a novel type of yacht configuration using a twin wing (or foil) steering and leeway control. As used herein, the words "wing" and "foil" are interchangeable and define underwater appendages (for a yacht) having stream-lined hydrodynamic shape in cross section and having at least a flap portion, or up to its entirety, moveable about a generally vertical axis to form a control surface.

BACKGROUND OF THE INVENTION

Keels of early sailing ships were strong structural beams, usually made of wood, which extended in a straight line along at the bottom of their hulls. An example of this type of keel is the long keel incorporated in the yacht, Cygnet, shown in FIG. 1. Ballast, often rocks, was located inside the bottom of the hull, distributing its load along the keel's length. A rudder was mounted near the vertical rear end of the hull. Upwind performance was poor, reaching performance was useful. Structures were simple, loads were low.

Higher performance sailing yachts were developed in the nineteenth and twentieth centuries capable of improved upwind performance. This was possible with long keels of more advanced shapes capable of providing efficient hydrodynamic side loads and more effective righting moments. These new features were needed to oppose the large aerodynamic side force and heeling moments developed by the sails when sailing upwind. Some examples of the designs developed by naval designers over the years will be reviewed.

Long keels of curved planform and increased depth were used by Herreshoff's Gloriana in 1891, FIG. 2, and in the more recent 12-meter Columbia in 1958, FIG. 3. These boats retained a keel structurally integral with the hull, but placed the ballast concentrated near the bottom of the deeper keel, increasing its righting moments. The structural simplicity to support ballast is evident from FIG. 2. Control was achieved with an inclined rudder attached at the rear end of the keel. The rudder, having to support only its own loads on a long hinge, was a simple mechanism. Mast and sail position was not too sensitive, because of the long keel and large lateral area. Nevertheless, a reduction of wetted area was achieved with the curved planform, relative to Cygnet of FIG. 1.

Yachts with a shallower displacement hull, shaped independently of the keel, more recently called canoe, use fin keels. Examples are Herreshoff's Wenonah of 1892, FIG. 4, and the more recent Olympic class Soling, FIG. 5. The fin keels are usually made of lead, located near the center of the boat to provide two basic functions: hydrodynamic side force below the sail, and ballast to prevent excessive heel when sailing upwind. This type of yacht uses a separate conventional rear rudder located at the rear of the canoe for steering. These rudders turn on a cantilevered post. Mast and sail position are more critical than in boats with long keels. The fin keel and rudder are also called appendages to the canoe.

A modified approach of fin keel design has been tried in recent decades with large ballast concentration in torpedo-like bulbs or bullets located at the bottom of, and external to, the fin keel which can be made of cast iron. These ballast bodies are longer than the width of the fin keel itself, as, for example, in the Tempest shown in FIG. 6. This boat also uses a separate rear rudder. One disadvantage shown in FIG. 6 is that for a given overall draft 1, the span or vertical dimension 2 of the fin keel is obviously reduced by distance 3 due to the presence of the large bulb 4. Also, the structural thickness and shape of the fin keel has to be large enough to support the side loads due to the weight of the bulb when the yacht heels.

The development of aeronautical technology has made available new design approaches for improving fin keels, improving the two basic functions of the fin keel, which are retained. Some examples are listed below.

A trailing edge flap, first developed for aircraft wings by de Havilland in the 1920's, was added to the trailing edge of the fin keel of the 12-meter boats, for example, Intrepid and Australia II. For example, flap 5 in FIG. 7 enhances side force. Steering of these boats was attained with a separate rudder 6 also shown in FIG. 7. When sailing upwind, the pressure differences between the leeward side and the windward side of the fin keel also causes a hydrodynamic side force which also helps to oppose the sail's side force. These boats won the America's Cup in 1972 and 1983, respectively. All subsequent successful 12-meter boats have used fin keels with flaps.

More recently, winglets, first developed by NASA's Dr. Whitcomb as a device conceptually different from endplates, was successfully incorporated by Sloof and others at the bottom of a fin keel of a 12-meter yacht Australia II, shown as device 7 in FIG. 7. A lead winglet is especially effective, since it obviously lowers the center of mass of the fin keel, but unlike the bulb of the Tempest, it increases the effective span of the fin keel when sailing heeled upwind. This type of keel, which was used by the winning boats of the 1983 and 1987 America's Cup, permits effective maneuvers with a conventional rear rudder.

Another interesting example of aeronautical influence on keels is the Collins' fin keel, conceptually related, according to Collins, to the aeronautical "joined wing." The Collins' keel is sketched in FIG. 8 from data described in the October 1986 *SEA HORSE* magazine. A lead bulb is attached at the bottom of the fin keel to increase ballast's righting moments, decreasing, for a given draft, the span of the fin keel, as was the case for the Tempest. Collins' fin keel itself, however, is slotted at the middle. The slot induces, according to Collins, a re-distribution of vortex flow which is beneficial for the hydrodynamics side force of the device. Yaw is obtained with a rear rudder 9.

Additional information on the Collins keel is available in U.S. Pat. No. 4,920,906, in which Collins teaches and claims a close coupling between the front and rear members of his keel, between which the slot is formed. Collins teaches that there should be a crossflow from the high pressure side of the forward member across the slot and the low pressure side of the rear member, that the front member should be smaller than the fixed portions of the rear member, and that the distance between his forward and rearward keel members is less than the chord of the rear member.

Other interesting examples of different designs related to keels and rudders are now reviewed.

FIG. 9 shows the 1974 12-meter Mariner using a fin keel for ballast and side force, and a deep bustle for expected hydrodynamic benefits using a blunt end not unlike those used in the aerodynamics of bullets and cars. Control for the Mariner was provided by a narrow rear rudder of small area and very high aspect ratio which protrudes below, instead of to the rear of the bustle. It therefore differs from Australia II's rudder, shown in FIG. 7. Mariner was reported to be difficult to maneuver.

FIG. 10 shows a 12-meter designed by I. Howlett, sketched from a 1977 issue of *SEA HORSE* magazine. It uses a fin keel to provide side force and ballast. Steering is obtained with an under-slung rear rudder of high aspect ratio very similar to the Mariner. The design also shows a front foil of high aspect ratio and considerable depth. While Howlett's fin keel design of FIG. 12 apparently has been tank tested, it was not used in his 12-meter designs which have been challengers to the America's Cup before or after the publication of that article.

The above designs appear to cover extreme breadth of configuration, but upon analysis, respond to and share fundamental design features which may be summarized as follows:

(a) Keels provide hydrodynamic side force to oppose the sail's aerodynamic side force, and righting moments through ballast to oppose, when heeled, the sail's heeling moments, to permit upwind sailing; and, (b) Steering is provided by a separate rudder.

In consequence:

(c) The fin keel is of relatively large dimensions and is an important structural component, usually made of lead or cast iron, which supports large hydrodynamic and gravitational loads when heeled.

(d) The rudder is of relatively small dimensions and supports only its own loads.

(e) Mast and sail positions have been evolved over 100 years to define a well-proven criteria in which there is close proximity between fin keel's forward edge and the mast, and a large distance between the fin keel, mast, and rudder. The latter usually at the extreme rear end of the hull.

A completely different kind of yacht has been considered in the past, reproduced in FIG. 11 from a 1903 publication on a model yacht Gossoon. The hull of FIG. 11 comprises a canoe 10 with front foil 11 and rear foil 12 supporting a ballast body 13. According to the original Gossoon drawings, the vertical distance between the belly of the Gossoon's canoe and the top of the ballast is approximately the same as the average horizontal chord distance between the leading and trailing edges of either the front or rear foil of Gossoon and the vertical depth of his ballast body is almost the same as the draft of his canoe. In the horizontal direction, the spacing between the front and rear foils is about 4 times the horizontal chord of the foils. According to Marchaj's "Aerohydrodynamics of Sailing", Appendix 2, this type of design has been tried in an experimental yacht in 1968 and in models without noticeable success. Marchaj's picture of a wood model shows a vertical distance between belly of the canoe and top of hull approximately equal to twice the horizontal chord of either of his foils, and a horizontal distance between the foils of approximately three times the chord of the rear foil, which is the larger one. Marchaj's picture of a quarter-ton experimental yacht, apparently unsuccessful, shows that the vertical distance between the ballast body and the canoe body is also approximately twice the horizontal chord of the rear foil, and the horizontal space between the foils is also approximately three times, or three and one half times, the chord of the rear foil. This lack of success can be understood upon examination of FIG. 11, inasmuch as the previously reviewed design criteria for conventional yachts (paragraphs (a) through (e) above) do not apply to FIG. 11. Indeed, the word keel, denoting a single appendage that provides two functions (hydrodynamic side force and ballast) is not properly applicable to FIG. 11, because the foils of FIG. 11 are not ballast, since body 13 is the ballast. Also, if foil 11 were a "rudder", it would exhibit structural problems never experienced by earlier rudders, namely, the need to support about half of the weight of ballast 13. And, if it is a rudder, it is not seen how the small front foil can provide adequate forces against the sail's side force.

It is then clear that new design problems appear for FIG. 11, which conventional design criteria does not address: How can the configuration of FIG. 11 sail upwind? Where should its mast be positioned? How can a hydrodynamic side force on rudder-like foils oppose sail's side force and provide simultaneous steering? How should the structure be constructed if large ballast weights are to be supported by rudder-like foils? The absence of these type of boats in general use indicates they appear to have no purpose, or no solution has been found to these problems.

SUMMARY OF THE INVENTION AND OBJECTS

The invention is described in the specifications and drawings.

It is a general object of the present invention to provide a sailing yacht construction having twin wings or foils which will overcome the above disadvantages and limitations.

It is a further object of the invention to provide a yacht construction of the above character which specifies a unique combination of volume distribution of the components of a hull (canoe, foils, and ballast body) along the hull's long dimension, to obtain minimum wave-making drag for the design when sailing upwind.

It is a further object of the invention to provide a sailing yacht of the above character which specifies the critical longitudinal distribution of area of foil and sail to provide efficient upwind sailing for the design.

It is a further object of the invention to provide a sailing yacht of the above character which provides a unique twin-foil ballast body structural combination capable of stiffening the canoe in the longitudinal direction.

It is a further object of the invention to provide a sailing yacht of the above character which provides a special shape and distribution of foils and ballast body which results in minimum wetted area, maximum righting moments, and satisfactory hydrodynamic side force for upwind sailing and steering of the boat.

It is a further object of the invention to provide a sailing yacht of the above character which provides an innovative, efficient structural design of the foils to transmit the loads of the ballast body and discharge them into the canoe's body when the boat is heeled.

It is a further object of the invention to provide a sailing yacht of the above character which provides new structural and mechanical design of variable camber foils capable of supporting heavy ballast bodies, and of operating mechanically with efficiency with the foils deflected when the yacht is heeled.

It is a further object of the invention to provide a sailing yacht of the above character which provides structural and mechanical design of spade foils capable of supporting heavy ballast bodies, and of operating mechanically with efficiency when the yacht is heeled.

It is a further object of the invention to provide a sailing yacht of the above character which specifies the structural design for the foils of the configuration to support large heavy ballast, including critical foil taper in planform and thickness, and high-lift devices.

It is a further object of the invention to provide a sailing yacht of the above character which specifies the special hydrodynamic foil shape and angular positions to permit sailing upwind and turning of the yacht.

It is a further object of the invention to provide a sailing yacht of the above character which specifies the unique mechanical system to command and obtain the necessary positions of the foils to permit sailing upwind and turning.

It is a further object of the invention to provide a sailing yacht of the above character which provides the special shapes of foils and flaps to permit upwind sailing and maneuvering.

It is a further object of the invention to provide a sailing yacht of the above character which structurally supports a long ballast body at its ends with critical stiffness sufficient to prevent adverse hydro-elastic phenomena, including the case of the heeled yacht.

It is a further object of the invention to provide a sailing yacht of the above character which provides special shape of a ballast body which, when supported at its ends by the foils, does not decrease the effective span of the foils.

It is a further object of the invention to provide a sailing yacht of the above character which structurally supports a long ballast body from foils which flex when the boat is heeled, with ballast body specially shaped such that its center of gravity with foils flexed is nevertheless capable of providing large righting moments.

It is a further object of the invention to provide a sailing yacht of the above character which structurally supports a long ballast body from the foils by means of unique stiff structure internal to the ballast body, protruding at its ends in streamlined arms which attach to the lower end of the foils.

These and other objectives of the invention are defined in greater detail in the following detailed description when taken with the accompanying drawings, of which:

BRIEF DESCRIPTION OF DRAWINGS

FIGS. 1A–1B, 2A–2C, 3, 4A–4C, 5A–5C, 6, 7A–7C, 8, 9, and 10 show the historical evolution of keels and rudders for prior art yachts. These are the conventional appendages that provide hydrodynamic side force, ballast and steering for a yacht.

FIG. 13 is a diagrammatic elevational view showing the hydrodynamic field developed by a conventional yacht.

FIGS. 14A–14D are diagrammatic elevational views showing the distribution of submerged volumes of a standard yacht.

FIGS. 15A–15D are diagrammatic elevational views showing the new distribution of submerged volumes of the present invention.

FIG. 16 is a diagrammatic elevational view of a tandem ballast twin foil yacht constructed in accordance with the present invention.

FIG. 17 is a diagrammatic elevational view of another embodiment of tandem ballast twin foil yacht constructed in accordance with the present invention.

FIG. 18 is a diagrammatic elevational view of another embodiment of tandem ballast twin foil yacht constructed in accordance with the present invention.

FIG. 19 is an isometric view, taken from below the water line, and forward of abeam, showing another embodiment of a yacht constructed in accordance with the present invention.

FIG. 20 is a diagrammatic elevational view of a yacht similar to that of FIG. 19 and constructed in accordance with the present invention.

FIG. 22 is a diagrammatic elevational view of another embodiment of the present invention.

FIGS. 23–26 shows outlines of cross-sectional shapes for the tandem ballast of a yacht constructed in accordance with the present invention.

FIG. 27 is a horizontal cross-sectional view taken through a foil of FIG. 20 taken along the lines 27—27 thereof.

FIG. 28 is a view of a foil similar to that of FIG. 27 showing the same turned through an angle $\delta_w$ together with a flap portion set for a particular adjustable camber $\delta_f$.

FIG. 29 is a graph showing the relationship of angle of attack for the flap ($\delta_f$) to the angle of attack of the foil ($\delta_w$).

FIG. 30 is an elevational view of a foil similar to that of FIG. 27 showing the relative chords.

FIG. 31 illustrates the relation of planform to axis of rotation for the foils of FIGS. 27–30.

FIGS. 32–36 show the aerodynamics and hydrodynamics of sailing the yacht of the present invention.

DETAILED DESCRIPTION OF THE PREFERRED EMBODIMENTS

Figure 7A:
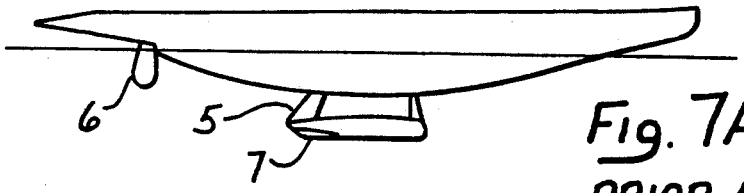
Fig. 7A PRIOR ART
Figure 7B:
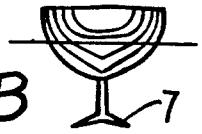
Fig. 7B PRIOR ART
Figure 7C:
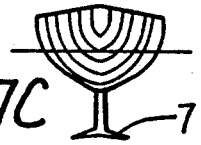
Fig. 7C PRIOR ART
Figure 8:
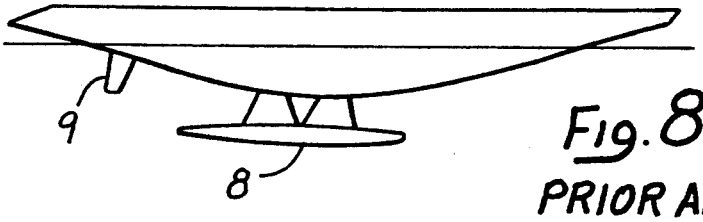
Fig. 8 PRIOR ART
Figure 9:
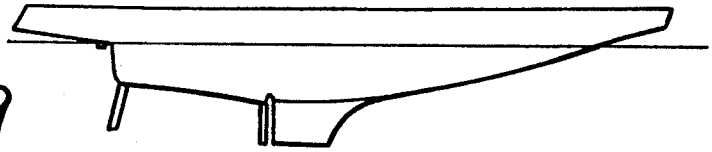
Fig. 9 PRIOR ART
Figure 10:
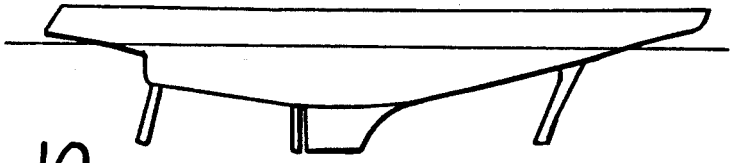
Fig. 10 PRIOR ART
Figure 11:
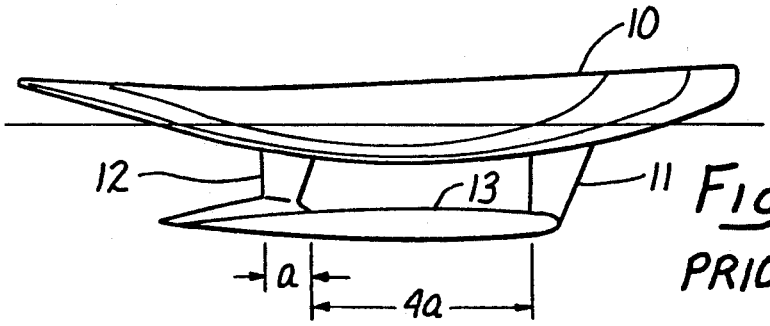
Fig. 11 PRIOR ART
FIG. 11 shows a different type of appendage proposed some time ago for model yachts and reported to have been attempted in experimental yachts.

The present invention is shown in the drawings from FIG. 15 through FIG. 32. Before proceeding with that description, it is necessary to consider the operation of conventional yacht designs in detail. However, the following questions need to be addressed to understand the description of the present invention. The first question is: Why (not how) do yachts turn? The answer is needed to solve the side force turning problems of the yacht configuration of the present invention. The second question is: What are the fundamental hydrodynamic phenomena which limit upwind performance of conventional shapes to top speeds well below hull speed, and what are new hydrodynamic feature of the present invention, which features are not taught by prior art?

In answer to the first question, there is a general popular view that rudders make a boat turn. According to the examination of the dynamics of boat turning, this is not the case. It has been discovered and then quantified a fundamental third function of side force appendage, beyond its acknowledged hydrodynamic opposition to sail's side force and the keel's housing of gravitational ballast to oppose heel due to sail's side force. This third function (which is separate from a fourth function also discovered) is providing centripetal forces to cause centripetal acceleration, which are essential for turning, in accordance to Newton's second law. This third function is a discovery in the sense that it negates the widespread belief that a rudder makes a boat turn, and on the contrary, it establishes that the rudder's force, in fact, opposes a turning path.

Figure 12:
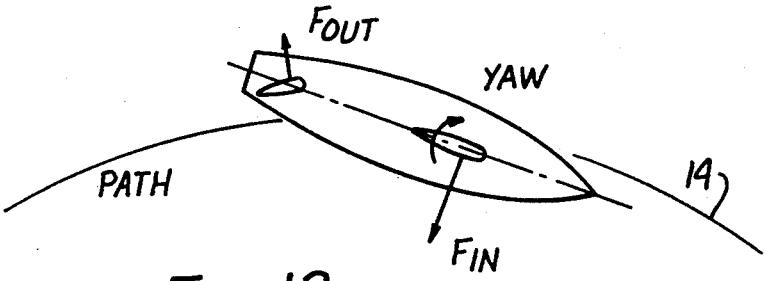
Fig. 12 PRIOR ART
FIG. 12 is a diagram which shows the forces necessary to make a sailing yacht turn and yaw.

The function of a rudder, upon examination in FIG. 12, can only be to yaw a boat. Yaw is rotation about a vertical axis through the boat. A turn exists only if there is a curved path of the yacht moving in the water, for example, path 14 in FIG. 12. Evidently, the rudder, when moved to one side develops a side force $F_{out}$ in FIG. 12 which yaws the boat towards the intended path, but it also actually opposes turning along the intended path, in that $F_{out}$ is a centrifugal or outward force which opposes the centripetal or inward force $F_{in}$ which, according to Newton's second law, is the only way there can exist a turn, i.e., a curvilinear path 14. The curved path of motion called a turn is only possible when governed by the following equation:

$$F_{in}=M\cdot a+F_{out} \quad (1)$$

where

M is the mass of the boat, and a is its centripetal acceleration, in the direction of F in such that $$a=\frac{F_{in}-F_{out}}{M} \quad (2)$$

The above equation shows that the curved path for maneuvering can exist notwithstanding the rudder's outward force $F_{out}$, only if something—for example, a properly designed side force appendage—provides an additional third function, namely, developing a centripetal force $F_{in}$ as shown in FIG. 12, overcoming the opposition to turning which the rudder's outward force generates according to equation (1). How this equation permits the development of the hull configuration, of the present invention, will be reviewed later on, in connection to a description of its foils and controls.

Before that, however, the second question must be addressed, initially by reviewing the basic hydrodynamics of a conventional yacht with a fin keel and rudder.

FIG. 13 shows in side view the hull of a conventional sailing yacht. The hull's main components are a displacement canoe 20 with lead fin keel 21 which provides ballast as well as hydrodynamic side force when the canoe is sailed at a given angle of heel and at a given leeway angle. Flap 22 is used to optimize the side force on the fin keel. A conventional rudder 23 is located to the rear of the canoe. The rudder has small area, and its draft 24 from the displacement waterplane 25 is less than draft 26 of the fin keel.

One important hydrodynamic parameter of the fin keel yacht of FIG. 13 is its unfavorably short hydrodynamic span 27 on the windward side of the upwind canoe, compared to the hull's draft 26. Also note the large amplitude 28 of the surface wave generated by the hull, which is very adverse for resistance near hull speed VH, and the unfavorable position the rudder's root close to the water's surface. This is an adverse condition for resistance and side force capability of the rudder, particularly in rough water.

The total hydrodynamic resistance of a sailing yacht hull such as that of FIG. 13 can be analyzed, according to various texts and papers on yacht design, in terms of the following components of resistance:

1) Drag originating in viscosity (surface friction, form drag, eddies);

2) Induced drag due to side force, which contributes to shape a submerged flow field and surface field;

3) Wave-making drag due to displacement, which contributes to shape a submerged flow field and surface field; and 4) Added drag due to sea waves.

When the displacement yacht is sailed nearly upright (downwind or broad reaching) at speeds approaching its terminal hull spe VH, it encounters a rapid hydrodynamic build-up ncipally due to an increased wave-making of the canoe. This drag is believed to be an inevitable physical property of a displacement type hull (as distinct from planing hulls) when moved forward through the water at a speed near VH, at which the trough of its single wave is located generally near the mid-body of the canoe.

The higher resistance which a heeled canoe encounters upwind at a slower speed than VH, compared to a near upright canoe at a higher speed VH, is usually explained in terms of the added induced drag due to hydrodynamic side force of the fin keel and added form drag due to the non-optimum asymmetric shape of the heeled canoe at a leeway angle. The above statements are explained in greater detail in various papers and texts on sailing yachts.

However, research on the fundamental and applied hydrodynamics of sailing yachts and their drag explanations done in the development of the present invention has led firstly to question the adequacy of the current designs of displacement hulls using a fin keel and a rudder, and secondly, to the formulation of new designs for various types of yachts with superior results. Before reviewing the present new design features and details, a list is provided of the concerns had with respect to the rationale of conventional sailing yachts.

The fundamental hydrodynamic aspects of the investigation cover not only steady motion, but accelerated motion and includes re-examination of the physical significance for sailing yacht design of the classic parameters such as Froude number, Reynolds number, submergence depth, and virtual mass. Some of these concerns are here outlined:

1) The current Froude number definition as used in naval architecture for some reason omits the water density term of Froude's original definitions.

2) The treatment of dynamic conditions in which virtual mass is applicable formally require an associated virtual Froude number.

3) Hull speed VH is a convenient term of kinematic significance, but is not invested with intrinsic properties of a governing law of physics.

4) The use of the Froude number for a hull in uniform motion may be statistically significant in respect to VH, when comparing hulls of similar shapes. However, it is not useful when applied to a completely new configuration.

5) New configurations which separate side force and righting moment appendages do not have a single physically significant Froude number, but instead, Froude numbers for each component of the hull.

6) Similar separation should be applied to Reynolds and Weber numbers.

7) A submergence depth parameter is inadequate by itself to handle upwind conditions of the sailing yacht at various boat speeds.

8) Drag equations which are used to estimate performance of yachts are analytically incomplete with respect to the number and significance of drag terms in smooth and rough water.

9) The complete equation for drag of a conventional sailing yacht with a fin keel and a rudder has 108 terms, the effects of which are not formally taken into account in the published equations, except in terms of empirical corrective factors evaluated from experience. It is this experience which clouds the fundamental nature of the flow phenomena and has impeded, in the past, the correct formulation of new designs clear of tradition.

With respect to applied hydrodynamics, the following are of primary concern:

1) Sea waves impact an analytically complete drag equation, adding formidable complexity for evaluating the effects of each drag term. However, this is no more serious, conceptually, than rough weather effects on drag of aircraft.

2) There appears to be a total lack of quantitative concern with respect to accelerated motions of the hull, even though accelerated motion is the predominant mode in upwind sailing and during maneuvers, and defines the associated drag and side force flow phenomena.

3) The dynamics and design requirements of sailing yachts are amenable to analytic treatment in accordance to equations describing aircraft maneuvers, for example, centripetal forces, damping in roll, etc.

4) There appears to be no published experimental data pertaining to forces applied by dynamic pressure of the water to appendages near the surface, either in smooth water or in sea waves.

Nevertheless, the complete analytic formulation of drag terms of the total hydrodynamic resistance of a conventional hull has been established in the researches leading to the present invention, using aerodynamic and hydrodynamic criteria relating to the design of aircraft, seaplanes, hydrofoils, submersibles, and submarines. This has permitted (a) reasonable classification of the significant and the insignificant members of the 108 drag terms of a conventional yacht, and (b) because of its clear analytic form, it has been adequately modified with only the significant terms, in accordance to the needs of more complex configurations, independent of fin keel and rudder tradition.

Of these new significant terms, there has been ascertained the large importance of a term covering the interactive nature, when sailing upwind, of the three-dimensional deformations due to (a) hydrodynamic side force and pressures of the appendages, (b) the upper vortex drag member of the induced drag system of the side force appendages, and (c) the wave-making generated by the longitudinal distribution of the canoe's volume. For conventional yacht designs, their additive combination has very adverse drag results and sets one of the upper limits of upwind sailing speed considerably below the hull speed limit VH.

The volume distribution of a conventional yacht design has intrinsic problems reviewed in FIG. 14. FIG. 14 shows a hull 31. It comprises submerged canoe portion 32, fin keel 33, and rudder 34. The corresponding individual submerged volumes are 35 (FIG. 14B), 36 and 37 (FIG. 14C), shown proportional to a vertical local volume scale V. The addition of submerged volumes is 38 (FIG. 14D). It is very peaky, for example, at 39, and bumpy near surface at 40, causing wave-making problems already reviewed in FIG. 13, for example, wave trough 29 and wave amplitude 28.

For the present invention, a very different distribution of submerged volumes is prescribed, which by way of illustration, is referred to as submerged canoe 41 in FIG. 15 (same as 32 of FIG. 14) having a front foil 42, a rear foil 44, and a ballast body 43 suspended in between. The corresponding submerged volumes are 45 (FIG. 15B, for the hull canoe), and 47, 48 and 46 (FIG. 15C), respectively. Their addition is shown as 49 which is much smoother and has much less maximum volume in the vertical scale V than in FIG. 14, even though total submerged volume of the present invention (FIG. 15) may be the same as that of FIG. 14.

Referring now to FIGS. 15 and 16. This is shown how canoe 50, in presence of its appendages 51, 53, and 55, generates a peculiarly favorable hydrodynamic surface wave structure with a trough 56, front wave crest **56*f*, and rear wave crest 56*r*, all relative to undisturbed water level 56*u* far ahead of the hull. This surface wave is a hydrodynamic structure attached to the canoe and traveling with it, supporting the yacht's weight by hydrostatic displacement with unique efficiency with a strong buoyant lift contribution from mid-canoe, due to reduced depth of trough, and moreover, because of its peculiar decrement of wave amplitude 57 from crest to trough, as explained in terms of the unique submerged volumetric distribution of the yacht of FIG. 15, and achieves less wave making resistance as well, particularly when sailing upwind, as side force appendages 51 and 53 are placed forward and aft of wave trough 56**.

In FIG. 16, there is also shown the details of front foil 51 having an axis of rotation 52, and a rear foil 53 having an axis of rotation 54. The foils include structure for supporting a ballast body 55. As mentioned, the superior volumetric distribution results in a reduced trough 56, much shallower, for example, than 29 in FIG. 13, and a wave amplitude 57 much less than 28 in FIG. 13. This decreases wave drag, but nevertheless increases the hydrodynamic span 58 of the foils 51 and 53, compared to span 27 of FIG. 13. The downwind (upright) wave-making drag is decreased by the shallower trough. The upwind (heeled) wave-making drag, however, is decreased substantially by the fact that the low pressure side of the foils 51 and 53 is away from shallow trough 56. This avoids the increment of trough depth which conventional keels create when sailing upwind such as is shown in trough 30 of FIG. 13. FIG. 16 also shows a small depth 59 for Ballast body, compared to its length, which decreases volumetric interference with the submerged canoe, to decrease wave drag, especially downwind. Body 55 has a very small depth 60 of the forward attachment end compared to depth 59. This increases span of foil 51. The combination of these design features are exceptionally favorable when sailing upwind, in that simultaneously they (a) minimize submerged and near surface volumetric interference, reducing wave-making drag; (b) minimize by the long effective hydrodynamic span energy of the trailing members of the induced drag system; and (c) eliminate, by location choice fore and aft of trough, the interference between low pressure region of side force appendages and the trough of the surface wave generated by the canoe's midbody displacement.

The wave making reduction advantage of the invention grows as the yacht is heavier and/or shorter, and obviously diminishes for a light boat. According to studies done in the development of this invention, there are significant advantages where the weight expressed in tons, divided by the quantity—(water line(in feet)/100)$^3$—, i.e. the displacement-to-length ratio, yields a ratio of about 100 or more; the greater the ratio, the larger the advantage, especially at values of 200 or more.

In FIG. 17, the embodiment of the present invention has a rear foil 61 with axis of rotation 63 located approximately below crest of stern wave and the root of swept front foil 65 with flap 66 located below crest of bow wave. This increases the hydrodynamic span of the foils, since the crest is higher than the remote water level. Thus, hydrodynamic effective span of the foils in FIG. 17 is larger than 58 in the FIG. 16, and much larger than the 27 standard keel in FIG. 13. A very long ballast body 68 having a small height 69 compared to its length, decreases volumetric interference with the canoe. Structural depth 70 at ends of ballast body is very small compared to 69 near its middle. This increases span of foil 61 to substantially maximum draft value. This embodiment of the present invention has less total wave-making drag. Maneuvering is achieved with the unique combination of a rotating wing 61 aft with a variable camber front wing, with type of controls to be specified in later figures.

In FIG. 18, there is shown a special canoe shape with an under waist 72 which is above the ballast body 73, to decrease the magnitude of submerged volumes added in the region between the foils (see FIG. 15), which allows greater volume for ballast body 73 with minimum interference relative to the canoe. A variable camber rear wing 74 and fixed camber fixed incidence front wing 75 support ballast 73.

FIG. 18 also shows that the relation between the vertical draft or depth between the water and the bottom of the rear wing and ballast, and the chord of the rear wing perpendicular to its length, should be large, about 3.5 times in this embodiment, and preferably larger values of 6, or more as in FIGS. 15 and 16. These proportions, as well as the relations of chord to distance between foils, are important because they embody hydrodynamic span, structural strength, shape of associated surface wave that travel with the hull, wave making and induced drag, better surface, efficiency of ballast, and controllability of the hull.

FIG. 19 shows an isometric view of the present invention in which canoe 80 has a forward variable camber wing 81 with flap 82, a rear wing 83 with aft flap 84, a ballast body 85 with a cambered squashed cross-section 86, and a mast 87. Notice the very fine ends of body 85 and its flat lower surface, for lowest center of gravity of ballast and maximum span of foils.

Figures 21, 21A:
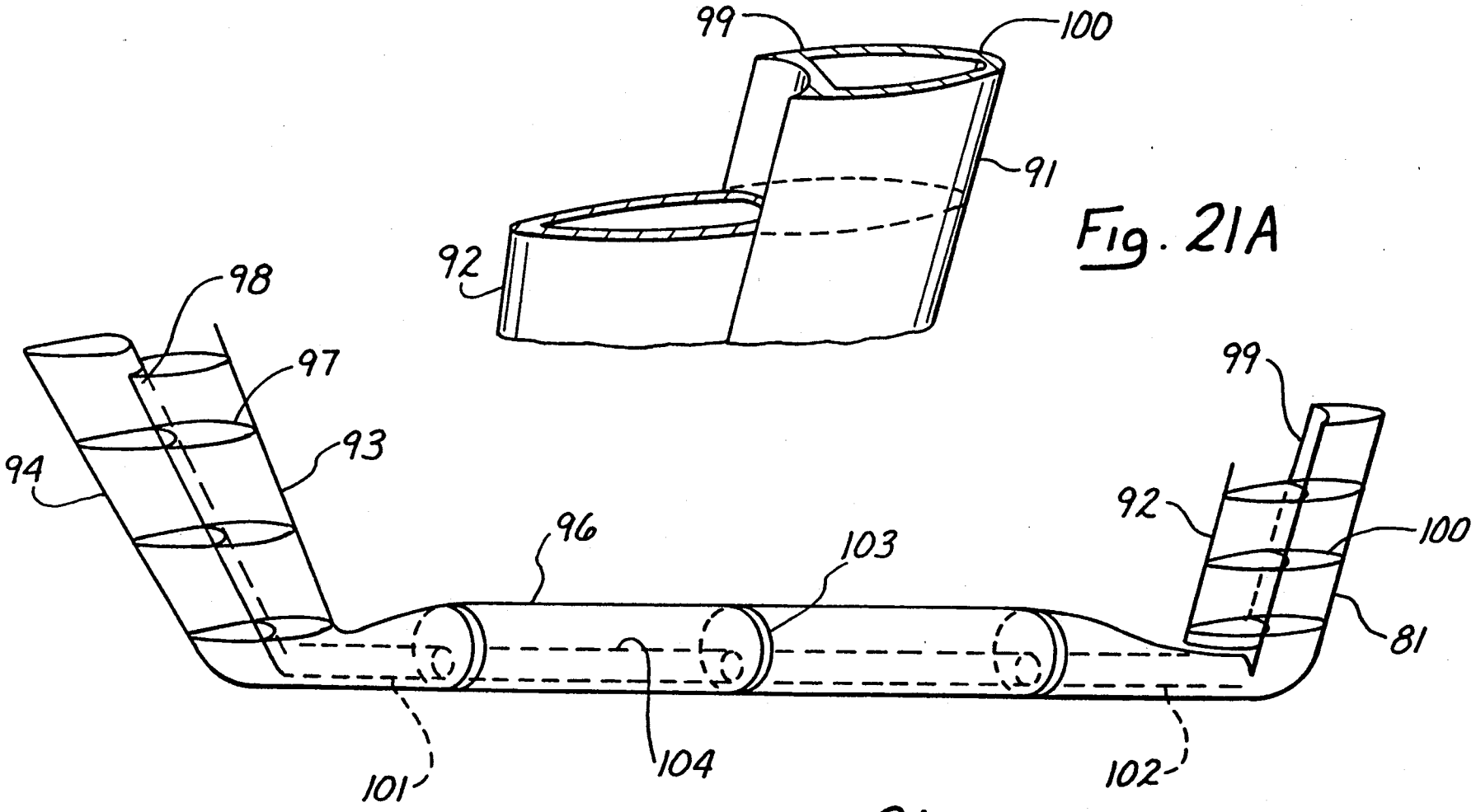
FIG. 21 is a diagrammatic view in elevation, illustrating the construction of 16 tandem ballast twin foil structures of FIG. 20.
FIG. 21A is an enlarged view of the wing and flap construction of FIG. 21.

FIG. 20 shows a similar embodiment (as FIG. 19) with canoe 90, front wing 91 with flap 92, rear wing 93 with flap 94 and root fairing 95, and ballast body 96. The special structural features of the embodiment of the invention of FIG. 20 are shown in FIG. 21. Front wing 91 has a main metallic or composite structural box (or D-nose) with main web spar 99 transferring for shear loads from ballast body when yacht is heeled, into the canoe; skins or outer surfaces 100 take the bending loads and torsion loads from ballast 96 when boat is heeled. Surface 99 also supports hinged flap 92. A similar arrangement is shown for rear wing 93 with surfaces 97, web 98 and flap 94. Ballast body 96 should be of lead (or other heavy substance), but lead cannot support loads at the thin ends of the body. Therefore, ballast body is fabricated with strong thin front metal arm 102 protruding from body 96 and attaching to the web spars 99–100 below wing 91; and the rear arm 101 protruding to the rear of 96 is attached to structural elements 98 and, if need be, below wing 93. Arms 101 and 102 can be joined with a strong metallic structural inside of body 96, or near its periphery, for example, with steel shape rings 103 extending about and spaced along the longitudinal dimension of body 96.

The front wing (foil of FIG. 21 is shown in larger scale in FIG. 21A, in which the structural cross-section of the forward element to be fixed to the canoe is in a "D" structural shape, with the trailing flap nested between the rearward protruding skins 99A or "lips" of the rearward structural section.

The embodiments of the invention in FIGS. 16 to 21 have observed certain proportions which are important to realize the hydrodynamic advantages of the invention, particularly in respect to a reduction in wave making by the heeled canoe. Accordingly, the horizontal spacing between the front and rear wings should be a large multiple of the horizontal chord of the wings, to avoid a "slot" effect, accompanying the pressure fields. A minimum horizontal distance between the foil should be approximately five times the average chord of the rear foil, and for optimum results this distance should be larger than 6 times the chord of the rear foil, or of the foil having the widest chord.

FIG. 22 shows another embodiment of the invention, in which canoe 106 has a rear wing 109 located near the rear end of static water line with the front wing having position 107 which is less subject to ventilation under sea waves than forward position 108. Position 108 of front wing, however, would be favored by use of two masts in the yacht.

The cross-sectional shapes of ballast bodies for this invention are shown circular in FIG. 23, elliptical in FIG. 24 with horizontal axis, semi-elliptical with vertical axis in FIG. 26, and a new shape in FIG. 25 with flattened lowered surface, and one with drooped sides, similar to shape of 86 of body 85 in FIG. 19. The forward and rear ends of body 85 should be near circular, for example, similar to FIG. 23 or 26, but of much less depth and width than 85.

The cross-sectional airfoil shape for the foils (wings) are shown in its most complex form in FIGS. 27 and 28.

FIG. 27 shows a canoe fore and aft reference line 136 along which wing 130 having chord line 132 is oriented in neutral position. Wing 130 has flap 133 articulated at axis 139 which is supported by wing 130. Wing 132 has aerodynamic center 131 which is also at or near pivot axis of the wing relative to canoe. The distance from leading edge to the axis is approximately 23% of the mean aerodynamic chord 135 of the wing. The flap chord 134 is relatively small, approximately 25%, since the wing 130 is pivoted at 131.

FIG. 28 shows how wing 132 can be turned by angle 137 relative to canoe reference line 136. Aiding the side force efficiency of wing 132 is flap 133, also deflected by angle 138. The relation between these angles is shown in axes 137 and 138 of FIG. 29. Typical pairs of wing angle/flap angle are 2°/1°, 4°/2°, 8°/6°, 10°/20°, 12°/30°, 14°/45°, and 30°/45°; another typical sequence is 1°/2°, 2°/4°, 3°/6°, 4°/8°, 10°/8°, 20°/8°, 30°/8°, 40°/8°, 50°/8°.

Moving wing 130 when supporting at its bottom approximately half the weight of a ballast body, as would be required, for example, for wing 61 in FIG. 17, requires a sophisticated and complex support for axis 131, as will be shown. This complexity is simplified by using a fixed forward component 140 of the wing in FIG. 30, using a much larger flap 141 which can be deflected away from neutral position to a deflected position 142 by about 30 degrees and considerably more. The ratio of flap chord 144 to total wing chord 145 should be longer than 30% and approximately 50% or more. This type of installation is shown in wing 81 of FIG. 19.

The relation between wing planform and position of wing's axle of rotation for the case of a tapered wing 150 is shown in FIG. 31 with axle of rotation 151 somewhat ahead of wing's hydrodynamic center 152. This would apply to wing 81 of FIG. 19, if its flap 82 were made stationary.

The manner in which the wings are deployed when sailing is shown in the following figures:

FIG. 32 shows downwind path generating apparent water speed vector 160 aligned with centerplane of front wing 161 and rear wing 162, with zero hydrodynamic side force from the wings, since there is no aerodynamic side force from the sails when sailing downwind.

FIG. 32 also shows that if an aerodynamic side force 164 were applied by making the boat sail upwind, leeway-making will occur, shifting apparent water speed vector to 163; leeway-making angle 165 is the result, as is usual for all conventional sailboats.

FIG. 33, however, shows the unique features of the twin wings which enable the yacht design to sail upwind with greatly reduced leeway, or even zero leeway. Opposing aerodynamic sail side force 167 are hydrodynamic side forces 168 and 169 generated by wings 162 and 161 respectively, without leeway angle, since upwind apparent water vector 166 is aligned with canoe centerline. This is feasible because both wings 162 and 161 are oriented relative to the canoe's longitudinal axis at angles 170 and 171 respectively, which substitute for leeway angle 165 in FIG. 32. When both foils are oriented to the same side for the boat, is referred to the corresponding control position as engaged in "collective".

The collective control is usually permanently engaged at a suitable angle when sailing upwind, the angle being proportional to the apparent wind and inversely proportional to the area of the wings and the water's pressure.

The angle can be slightly varied, if need be, on a per wave basis, to account for changes of water speed due to sea-wave orbitals and/or surfing tendencies. Collective can also be engaged to slip sideways or to generate centripetal forces.

FIG. 34 shows the position of the wings during a turn to the right. In steady state turn, wings 161 and 162 are determining curved path 178 with a yaw and centripetal contribution from force 179. Tightening the radius of turn can be accomplished by additional angular deflections 176 and 177. To generate centripetal forces from the canoe, wider angle 178 is engaged by rear wing, which may be advantageous with certain canoe shapes.

FIG. 35 shows a method to increase centripetal forces without incremental yaw, using approximately equal incremental wing angles 180 and 181 on the wings 161 and 162 respectively, relative to curvilinear path 182.

FIG. 36 shows wing positions for an increase of centripetal force and yaw couples with differential angles 183 and 184 of the wings 161 and 162 respectively, relative to path 185. Also shown is the intersection 186 of centripetal force vectors, which is not coincident, in transient motion, with instantaneous center 187 of path 185.

To determine the angular position of the wings relative to the canoe, it is necessary to have independent inputs for steering and for prevention of leeway. Opposite wing angles are used for steering, as in FIG. 34, which is called "cyclic" control. To generate traverse forces, as in FIGS. 33 and 35, similar angles are used, which is called "collective" control. This is accomplished by design principles of the control system embodied in FIG. 37.

Figure 37:
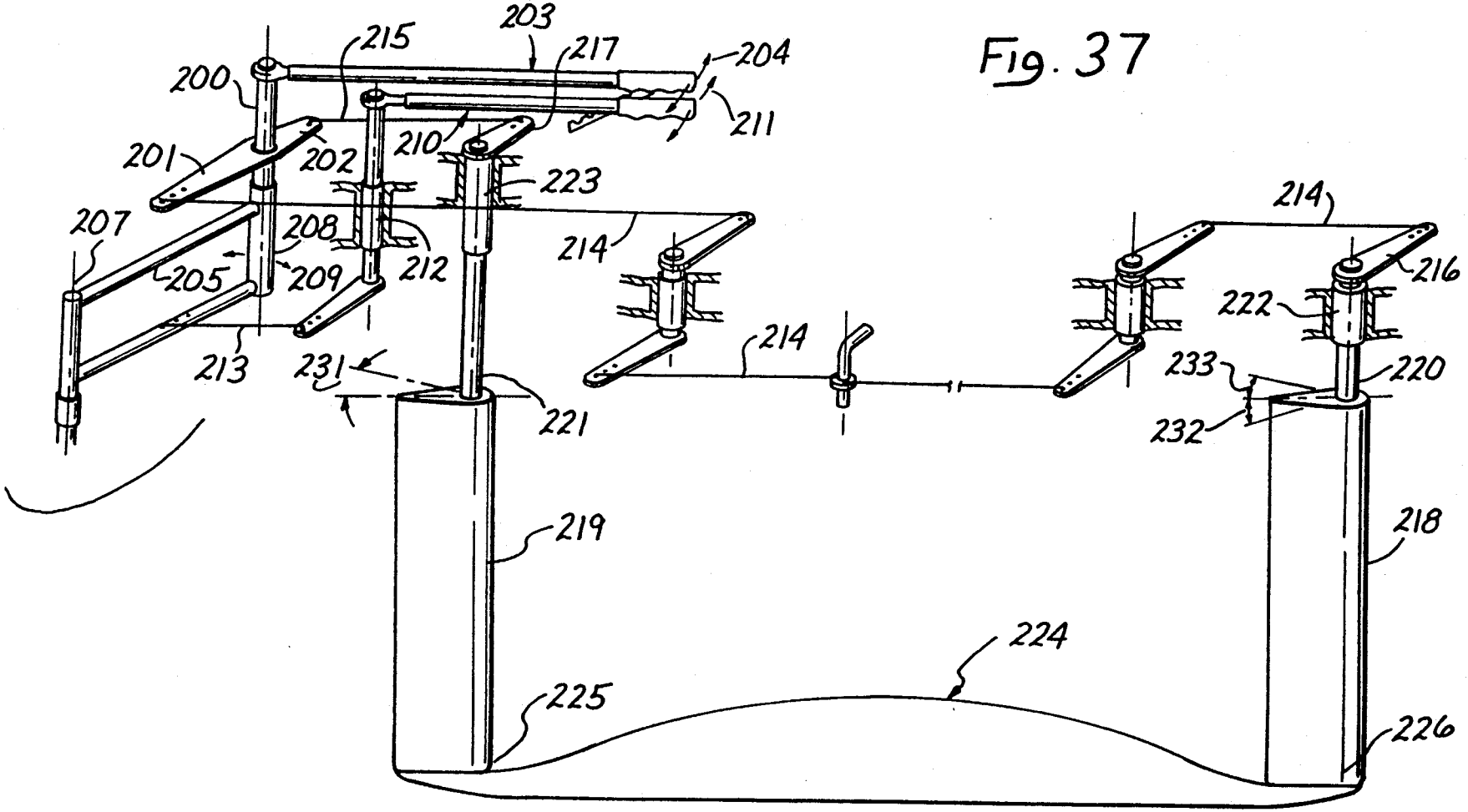
FIG. 37 is a schematic diagram of the control system for collective and cylic steering of the yacht, constructed in accordance with the present invention.

FIG. 37 incorporates the following:

(a) Control shaft 200 with output arms 201 and 202;

(b) Cyclic control tiller 203 which, when moved laterally port or starboard along 204, rotates shaft 200 as input, and therefore displaces tips of right and left arms 201 and 202 one forward and one rearward;

(c) Collective framework 205, articulated on canoe, for example, at hinge, 207 and supporting shaft 200 at end 208, which can translate fore-and-aft on paths 209;

(d) Collective tiller 210 mounted on canoe at hinge 212. Tiller can move laterally port or starboard along path 211 to introduce as input fore and aft motion of framework 205 through link 213, resulting in translation of shaft 200 and, therefore, translation input of tip of arms 201 and 202, either forward or aft, both tips in the same direction;

(e) Output push-pull rods 214 and 215 which are connected to horns 216 and 217 respectively, and are, therefore, capable of generating angular motion to wings 218 and 219 about shafts 220 and 221 respectively;

(f) Double ball bearing (or equivalent) supports 222 and 223 for shafts 220 and 221 respectively; and (g) Ballast body 224 supported at lower end of wings 218 and 219 by bearings 226 and 225 respectively.

It is evident from FIG. 37 that displacement of cyclic tiller 203 as input, while collective tiller 210 is held in neutral, will result as output opposite angular rotations 232 and 233 of wings 218 and 219 respectively, causing the yacht to turn for steering, to the left in FIG. 37.

It is also evident that displacement of collective tiller 210 as input, while cyclic tiller is held neutral, will result as output angular rotations 233 and 231 of wings 218 and 219 respectively, in the same direction, generating hydrodynamic side force, to the right in FIG. 37.

And it is also evident that combined inputs of collective and cyclic tillers will result in additive angular motion output of the wings in proportion to the displacement input of each of the tillers, which are additive through the net fore and aft displacement 209 and end of arm 201 and 202.

The embodiment of FIG. 37 illustrates the basic design principles of the control system, but can be varied without departing from the principles and spirit of the mechanism. For example, support 208 could be mounted on fore and aft tracks instead of hinge 207, or hinge 207 could be transferred to an athwarship position just below 203, which would virtually eliminate any fore and aft motion of tiller 203, or, indeed, in an athwarship position at bottom of 208. Further, while there is shown for simplicity of illustration the control system connections to flaps, it is evident that full wing section can be moved and controlled in the same manner.

Figure 37A:
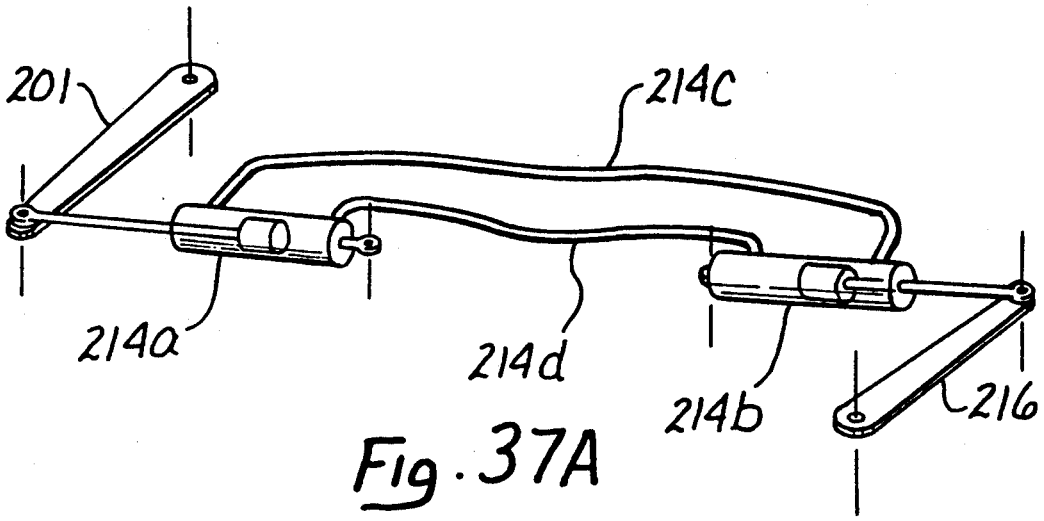
FIGS. 37A and 37B show alternated embodiments of control systems, constructed in accordance with the present invention.

An alternative embodiment of the control system of FIG. 37 is shown in FIG. 37A in which the mechanical push-pull rods 214 of FIG. 37 are replaced by a hydraulic system comprising rear piston 214*a* operated by control arm 201, front piston 214*b* which moves arm 216 of front wing, and interconnecting hydraulic lines 214*c* and 314*d* so that when 201 moves clockwise, 216 also moves clockwise, as in FIG. 37

Figure 37B:
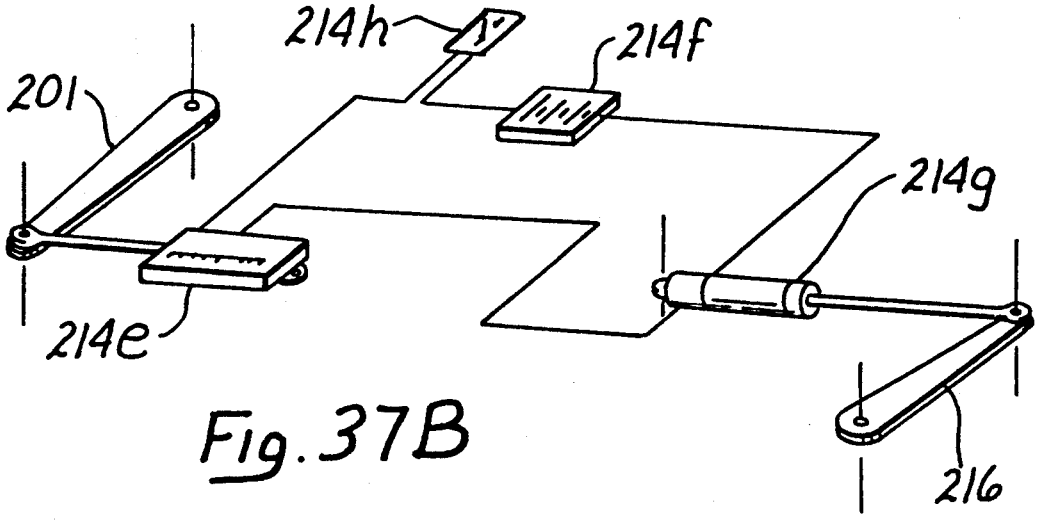

In another alternative of FIG. 37*b*, arm 201 moves linear resistance 214*e*, or an electric sensor, such that electric servo 214*g* under power from electric battery 214*f* moves arm 216 clockwise when 201 moves clockwise, as in FIG. 37. In FIG. 37*b*, there is shown on-off switch 214*h*, needed to energize the electro-mechanical control.

Figure 38:
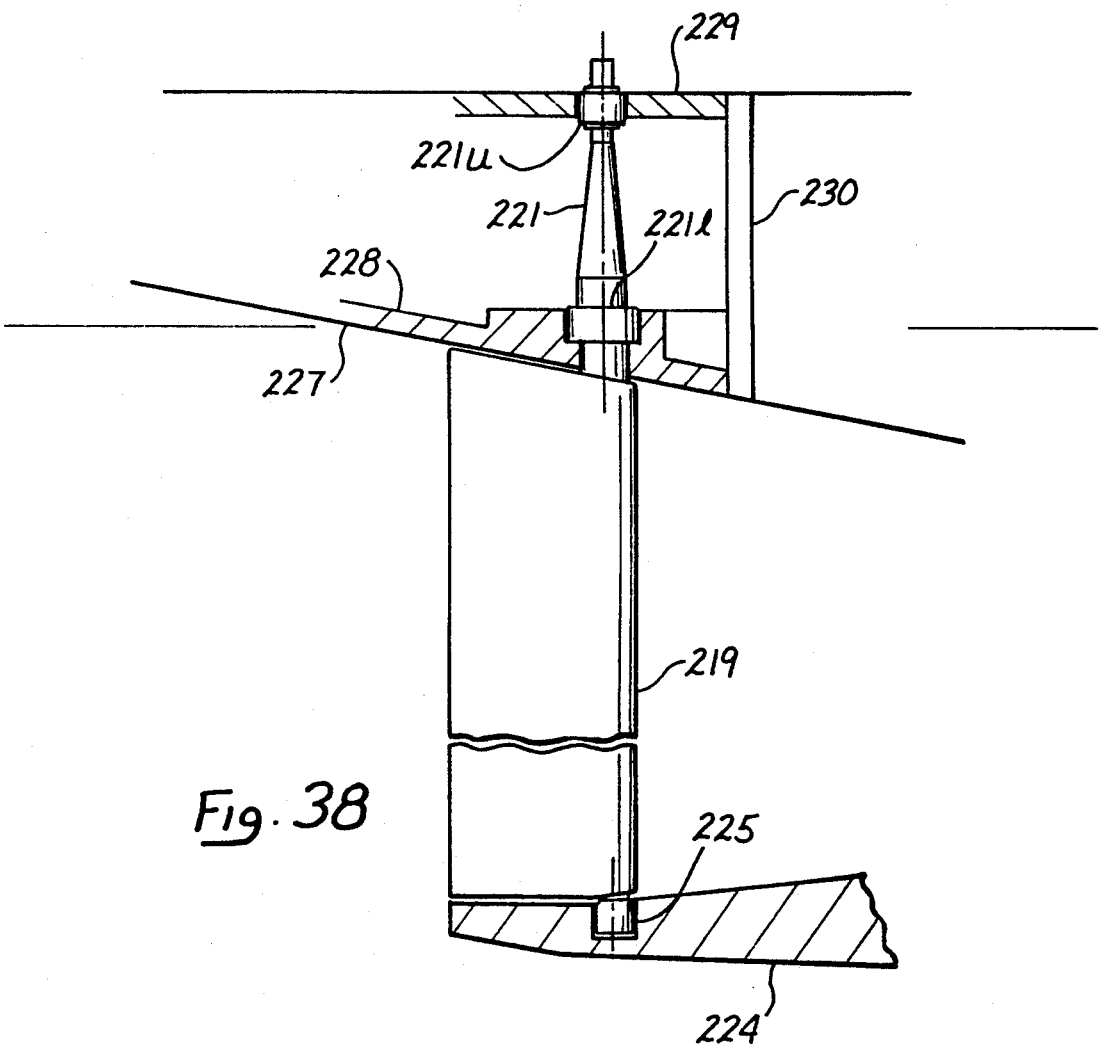
FIG. 38 is a diagramatic elevational view of the support structure for the wing and ballast of a yacht constructed in accordance with the present invention.

FIG. 38 shows the ball bearing details pertaining to the support of rear of ballast body 224 on rear wing 219, and rear wing 219 on the canoe 227. Specifically, shaft 221 of wing 219 is supported by large lower bearing 221-*l* and smaller upper bearing 221-*u*. These bearings are in turn supported partially by reinforced canoe floor 228, upper plate 229, and bulkhead 230, which take local loads from bearings and distribute it to canoe's mass and, to some extent, to the sails when sailing upwind. At lower end of wing 219, is shown bearing 225 which supports one end of ballast body 224.

Many other embodiments of the invention can be made without departing from its principles and spirit.

What is claimed is:

1. A twin wing yacht comprising:

a canoe;

a ballast body;

a front wing extending generally downwardly from said canoe and having a lower end;

a rear wing extending generally downwardly from said canoe and having a lower end;

means associated with said front and rear wings for structurally supporting said ballast body from and between said lower ends of said wings;

said front wing having at least a rearward portion thereof articulated about a generally downwardly extending axis to form a first, front moveable control element;

said rear wing having at least a rearward portion thereof articulated about a generally downwardly extending axis to form a second, rear moveable control element;

means connected to said front and rear control elements for cyclic turning thereof; and means connected to said front and rear control elements for collective turning thereof.

2. The twin wing yacht of claim 1 further characterized in that said rear wing has a chord between leading and trailing edges of said rear wing, and in that the horizontal distance between said front and said rear wings is greater than approximately five times the chord of said rear wing to avoid slot flow between said front and rear wing, and to reduce wave making of the hull when sailing upwind.

3. The twin wing yacht to claim 1 in which the distance between said rear and front wings is no less than the distance between the forward and rearward limits of the trough which said canoe generates on its windward side when sailing upwind near its maximum speed, whereby the surface elevation of the trough on right and left sides of said canoe tend to approximate the same level as flow can occur below the canoe from a high leeward side level to a windward lower side level over a length greater than twice the depth of said wings, thereby decreasing wave-making drag of said canoe when sailing upwind, while avoiding a slot between front and rear wings.

4. The twin wing yacht of claim 1 in which said ballast body has a maximum depth in side view between its forward and rear ends, and in that the depth of the rear and forward ends of said ballast body are no greater than 1/5 the body's maximum depth, and in that the vertical distance between the root of said wings and the top of said rear and forward ends of said ballast body is significantly larger than the vertical distance between the lower surface of said canoe and the upper surface of said ballast body adjacent said maximum depth of said ballast body.

5. The twin wing yacht of claim 1 in which the lower surface of said ballast body at its middle and at its forward and rear ends are all at approximately the same depth below the surface when the boat is floating stationary.

6. The twin wing yacht of claim 1 in which said ballast body is contained between the lower forward end of said forward wing and lower rear end of said rear wing.

7. The twin wing yacht as in claim 1, further characterized in that said rear wing has a long dimension and an average chord perpendicular to said long dimension, and in that the distance between the water surface and the bottom of said wing adjacent to said ballast is at least as large as approximately four times said chord.

8. The structure of claim 1 in which said wings are connected at their lower ends to said ballast body and connected at their upper end to said canoe, said wing has a main spar capable of receiving shear loads and a substantial portion of bending loads generated by the ballast when the boat is heeled, right and left skins capable of supporting significant portion of bending loads generated by the ballast, when the boat is heeled, said spar and skins being closed adjacent the leading edge to define a closed structural section capable of taking torsional loads generated by the ballast when the boat is heeled.

9. The structure of claim 8 in which said control elements are mounted to the rear of said wings and articulated on said wings, with forward control element terminating above said ballast body and with said rear control element extending behind the rear end of said ballast body.

10. The twin wing yacht of claim 1 further characterized in that each of said front and rear wings defines a root connected to said canoe, and further in which said wings collectively form substantially the entire side force appendages of said yacht.

11. A twin wing yacht comprising:

a canoe;

a ballast body;

a front wing extending generally downwardly from said canoe and having a lower end;

a rear wing extending generally downwardly from said canoe and having a lower end;

structural means included within each of said wings for supporting said ballast body from said canoe;

horizontal structural means connected to said lower ends and interconnected with said ballast body for supporting the same for movement with said yacht;

each of said wings including fixed forward wing portions rigidly attached to said canoe, and rearward facing flap portions articulated on said forward portions.

12. A twin wing yacht of claim 11 in which said rearward flap portions of said front and rear wings include cyclic turning means adapted to deflect laterally in opposite directions respectively to generate hydrodynamic yawing couple for steering said yacht, and collective turning means adapted to deflect said flap portions in the same direction to generate a hydrodynamic side force opposing the aerodynamic side force on said yacht when sailing upwind.

13. A twin wing yacht comprising:

a canoe;

a ballast body;

a front wing extending generally downwardly from said canoe and having a lower end;

a rear wing extending generally downwardly from said canoe and having a lower end;

structural means included within each of said wings for supporting said ballast from said canoe;

horizontal structural means connected to said lower ends and interconnected with said ballast body for supporting the same for movement with said yacht;

each of said wings including means forming full foils articulated about a generally downwardly extending axes within said wings.

14. The twin wing yacht of claim 13 further including cyclic turning means for deflecting said foils laterally in opposite directions to generate hydrodynamic yawing couple to steer said yacht, and collective turning means for deflecting said foils in the same direction to generate a hydrodynamic side force opposing the aerodynamic side force on said yacht when sailing upwind.

15. A twin wing yacht comprising:

a canoe;

a ballast body;

a front wing extending generally downwardly from said canoe and having a lower end;

a rear wing extending generally downwardly from said canoe and having a lower end;

structural member means included within each of said wings for supporting said ballast from said canoe;

horizontal structural means connected to said lower ends and interconnected with said ballast body for supporting the same for movement with said yacht;

said front wing including a fixed forward wing portion rigidly attached to said canoe, and a rearward facing flap portion articulated on said forward portion, said rear wing including means forming a full foil articulated about a generally downwardly extending axis.

16. The twin wing yacht of claim 15 further including cyclic turning means for deflecting said foil and said flap laterally in opposite directions to generate hydrodynamic yawing couple to steer said yacht, and collective turning means adapted to deflect said foil and said flap in the same direction to generate a hydrodynamic side force opposing the aerodynamic side force on said yacht when sailing upwind.

17. A twin wing yacht comprising:

a canoe;

a front wing depending from said canoe;

a rear wing depending from said canoe;

a ballast body mounted from and between the lower ends of said wings;

each of said wings including at least portions thereof forming control elements articulated thereon about generally downwardly extending axes;

control means including independently operable collective and cyclic control means, said collective control means serving to move said wings simultaneously in the same angular direction without opposite angular motion while said cyclic control remains neutral;

said cyclic control means serving to move said wings in opposite angular directions without angular motion in the same direction while the collective control remains neutral;

said cyclic and collective control means being also moveable simultaneously in which case the net angular motion of said wings responds in proportion to the relative motion of the cyclic and collective controls.

18. The twin wing yacht of claim 17 further characterized in that said control means comprises:

a collective framework which can displace fore and aft relative to said canoe; and a cyclic mechanical member which can rotate relative to said canoe.

19. The twin wing yacht of claim 18 further characterized in that:

said cyclic member is mounted on said collective framework, with said member having right and left arms with lateral tips portions which move fore and aft relative to the canoe in response to pure collective control application to said framework;

said tip portions moving in opposite direction in response to pure cyclic control application; and said tip portions moving in additive or subtractive manner in response to simultaneous application of cyclic and collective controls.

20. The twin wing yacht of claim 19 in which said collective control means includes:

(a) laterally extending control arms mounted on said control elements; and, further in which said cyclic means includes:

(b) fore and aft connecting means incorporated between said control arms and the arms of said cyclic member.

21. The twin wing yacht of claim 20 further characterized in that the arm lengths are adjusted so that the angular deflection associated with said front wing is different from that associated with the rear wing when the yacht is turned by said cyclic control means.

22. The twin wing yacht of claim 20 in which said connecting means are push-pull rods.

23. The twin wing yacht of claim 20 in which said connecting means include a hydraulic line between the output of one of the arms of said cyclic member and the arm of said front wing.

24. The twin wing yacht of claim 20 in which said connecting means include an electric sensor and line connecting an arm of said cyclic member and the arm of one of said wings.

25. The twin wing yacht of claim 20 in which said connecting means to the arm of one of said wings is a push-pull rod and to the other a hydraulic line with a piston adjacent said other arm.

26. A twin wing yacht comprising:

a canoe;

a ballast body;

a front wing extending generally downwardly from said canoe and having a lower end;

a rear wing extending generally downwardly from said canoe and having a lower end;

means for mounting said ballast body between the lower ends of said wings;

said front wing having at least a rearward portion thereof articulated about a generally vertical axis to form a first, front moveable control element;

said rear wing having at least a rearward portion thereof articulated about a generally vertical axis to form a second, rear moveable control element;

each of said front and rear wings defines a root portion connected to said canoe, and further in which said wings defining therebetween an essentially free space so that said wings collectively form the principal side force appendages of said yacht;

said canoe being constructed and arranged to move with a hydrodynamic surface wave structure attached to and traveling with the canoe, below which surface wave said canoe's displacement supports the principal weight of the yacht, with said displacement generating a wave trough adjacent the middle of said canoe on the windward side when sailing upwind, and in that the fore and aft position of said front and rear wings are forward and rearward of the principal surface depression of said trough, respectively.

27. The twin wing yacht of claim 26 in which said yacht has a displacement-to-length ratio greater than approximately 200.

28. The twin wing yacht of claim 26 in which said hydrodynamic wave structure includes a forward wave crest and a rearward wave crest, with the root of one of said front and rear wings being located under one of said crests.

29. The twin wing yacht of claim 28 in which the root of said forward and rear wings are located under the forward and rear wave crest, respectively.

30. A sailboat comprising:

a canoe;

a front wing depending from said canoe;

a rear wing depending from said canoe;

an elongated ballast body supported adjacent its front and rear ends by and between lower ends of said wings;

said front wing having a forward portion rigidly attached to said canoe with a rounded leading edge extending downwardly from said canoe towards said ballast body; a cusped aft end with rearwardly facing right and left lips extending downwardly from the canoe towards said ballast body; and right and left surfaces between said lips and said leading edge defining, in part, an airfoil section in a plane approximately perpendicular to said lips; and said front wing further having a rear flap articulated on said forward portion with said rear flap having a forward edge extending downwardly from said canoe towards said ballast body with said forward edge housed inside said cusped aft end, and a trailing edge extending from said canoe towards said ballast body, and a thickness contiguous said lips substantially equal to the distance between said lips with port and starboard surfaces of said rear flap extending rearwardly from said forward edge to said trailing edge defining, in a plane perpendicular of said rear flap, a cross-section of airfoil shape.

31. The sailboat as in claim 30 further including means for moving said rear flap to port or to starboard of said forward portion, thereby setting a cambered airfoil section and reversed cambered airfoil section respectively.

32. The sailboat as in claim 31 in which said rear wing includes a variable camber rear wing flap similar to the variable camber front wing flap.

33. The sailboat as in claim 32 having its variable camber flaps controlled by the control of claim 9.

* * * * *

UNITED STATES PATENT AND TRADEMARK OFFICE

CERTIFICATE OF CORRECTION

PATENT NO. : 5,313,905

DATED : May 24, 1994

INVENTOR(S) : Albert A. Calderon

It is certified that error appears in the above-indentified patent and that said Letters Patent is hereby corrected as shown below:

Column 1, lines 9 and 10, delete "and assigned to the same assignee as the present application,"

Signed and Sealed this

Third Day of December, 1996

*Attest:*

Bruce Lehman

BRUCE LEHMAN

*Attesting Officer*

*Commissioner of Patents and Trademarks*